US007866912B2

(12) United States Patent
Gelfand et al.

(10) Patent No.: US 7,866,912 B2
(45) Date of Patent: Jan. 11, 2011

(54) ENERGY ABSORBING BOLLARD SYSTEM

(75) Inventors: Matthew A. Gelfand, Rockville Centre, NY (US); Joel F. Hugghins, Bryan, TX (US)

(73) Assignee: Universal Safety Response, Inc., Franklin, TN (US)

( * ) Notice: Subject to any disclaimer, the term of this patent is extended or adjusted under 35 U.S.C. 154(b) by 0 days.

(21) Appl. No.: 12/317,428

(22) Filed: Dec. 23, 2008

(65) Prior Publication Data

US 2009/0116904 A1 May 7, 2009

Related U.S. Application Data

(63) Continuation of application No. 11/108,518, filed on Apr. 18, 2005, now Pat. No. 7,484,905.

(51) Int. Cl.
*E01F 15/00* (2006.01)

(52) U.S. Cl. ..... 404/6

(58) Field of Classification Search ..... 404/6, 404/9–11; 256/13.1

See application file for complete search history.

(56) References Cited

U.S. PATENT DOCUMENTS

| | | | | |
|---|---|---|---|---|
| 1,848,517 | A * | 3/1932 | Davison | 49/9 |
| 3,819,218 | A * | 6/1974 | Liu | 293/133 |
| 4,535,974 | A * | 8/1985 | Conde | 256/1 |
| 4,923,327 | A * | 5/1990 | Gorlov | 404/6 |
| 6,863,467 | B2 * | 3/2005 | Buehler et al. | 404/6 |
| 6,877,929 | B1 * | 4/2005 | Yang | 404/11 |
| 2005/0214672 | A1 * | 9/2005 | Blanchet-Fincher | 430/199 |

* cited by examiner

*Primary Examiner*—Raymond W Addie

(57) ABSTRACT

An energy absorbing system. The energy absorbing system includes a supporting member, a barrier pivotable between a first angular position and a second angular position, where the barrier becomes mechanically coupled to the supporting member when arranged at a predetermined angular position, and an energy absorber mechanically coupled to the supporting member, where the energy absorber absorbs energy when the supporting member travels from a first position to a second position.

19 Claims, 18 Drawing Sheets

ENERGY ABSORBING BOLLARD SYSTEM

This application is a continuation of U.S. patent application Ser. No. 11/108,518, filed Apr. 18, 2005, issued as U.S. Pat. No. 7,484,905, which is hereby incorporated by reference.

BACKGROUND

This invention relates to an energy absorbing bollard system where the system can be used to dissipate energy such as, e.g., the energy of a vehicle. The system may be used in a variety of applications, including HOV lane traffic control, drawbridges, security gates, or crash cushion applications. Due to the size and arrangement of the bollard, the system may act as a vehicle barrier having energy absorbing properties while permitting pedestrian traffic to pass. In one application, the system may be mobile, so that it may be moved between locations.

SUMMARY OF THE DISCLOSURE

The present disclosure relates to an energy absorbing system. In one aspect, the energy absorbing system includes a supporting member, a barrier pivotable between a first angular position and a second angular position, where the barrier becomes mechanically coupled to the supporting member when arranged at a predetermined angular position, and an energy absorber mechanically coupled to the supporting member, where the energy absorber absorbs energy when the supporting member travels from a first position to a second position.

DETAILED DESCRIPTION OF THE PREFERRED EMBODIMENTS

Figure 1:
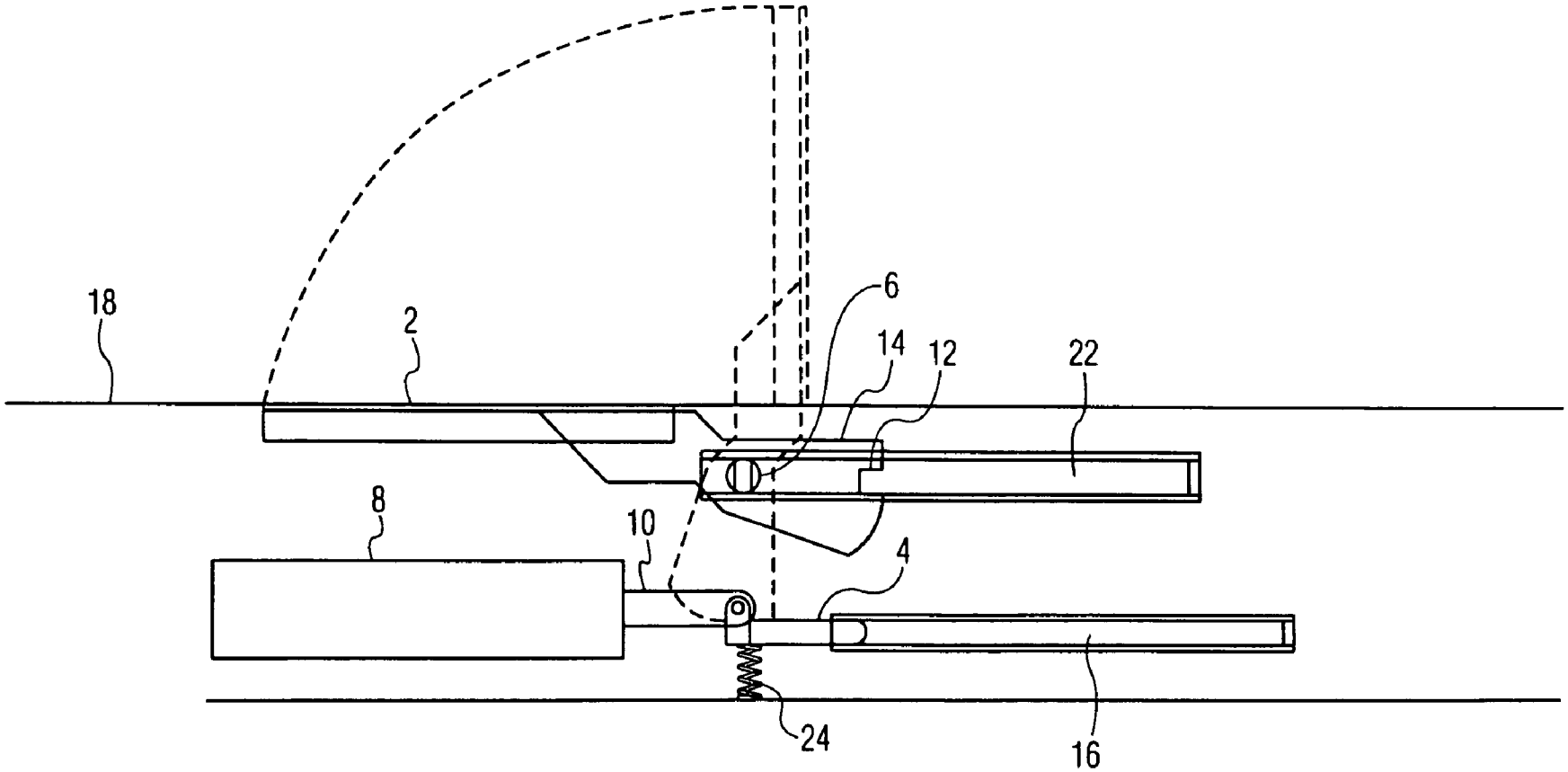
FIG. 1 shows a side view of an energy absorbing bollard system according to an aspect of the present disclosure.

Referring to the drawings, wherein like reference numerals represent identical or corresponding parts throughout the several views, and more particularly to FIG. 1, a side view of a general layout of an embodiment according to one aspect of the system of the present disclosure is shown. As shown in FIG. 1, in one aspect, the system may include at least bollard 2, sled 4, hinge 6, energy absorber 8, flange 14, sled guide 16, flange guide 22 and spring 24.

Figure 2A:
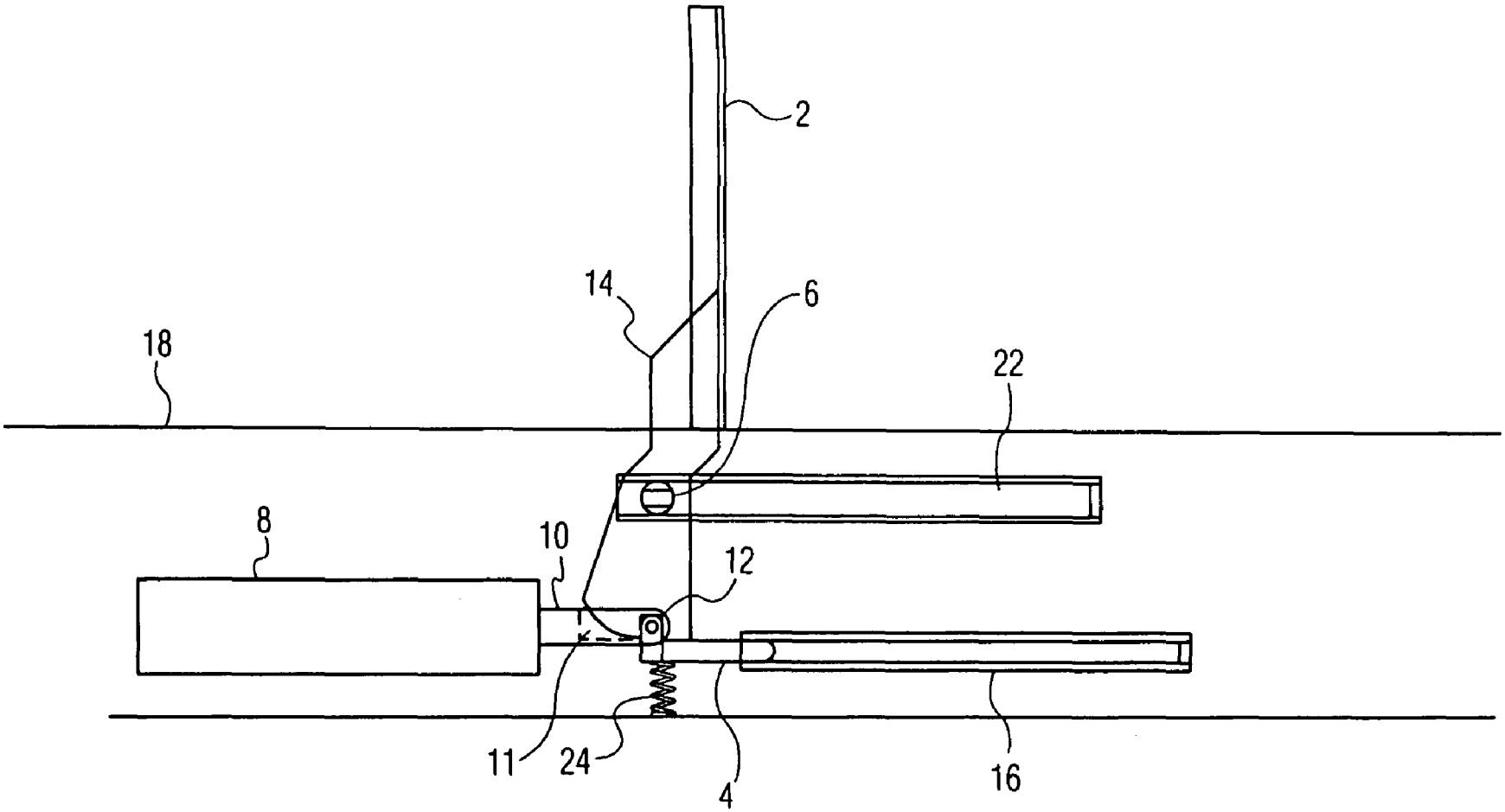
FIGS. 2A and 2B show side views of an energy absorbing bollard system according to an aspect of the present disclosure.

Bollard 2 may connect to flange 14. Bollard 2 may be fabricated from metal, metal reinforced rubber, concrete, ceramic, plastic or composite material. Bollard 2 may be formed in a 'T' shape so that the back side of bollard 2 may be flush with ground level 18 when in a lowered position. Flange 14 may be fitted with hinge, 6 allowing bollard 2 and flange 14 to pivot between lowered and raised positions. When in a lowered position, as shown in FIG. 1, bollard 2 and flange 14 may be substantially horizontal and/or parallel to ground level 18. When in a raised position, shown in FIG. 2A and drawn in dashed lines for illustrative purposes in FIG. 1, bollard 2 and flange 14 may be substantially vertical and/or perpendicular to ground level 18. In another aspect, bollard 2 and flange 14 may be arranged at an angle to ground level 18, such as a 45 degree angle. Hinge 6 may be a solid pin, gear and shaft, or sprocket gear, and may interface with flange guide 22. Flange guide 22 may be immovably fixed, for example, within concrete reinforced walls of a pit located beneath ground level 18.

Figure 2B:
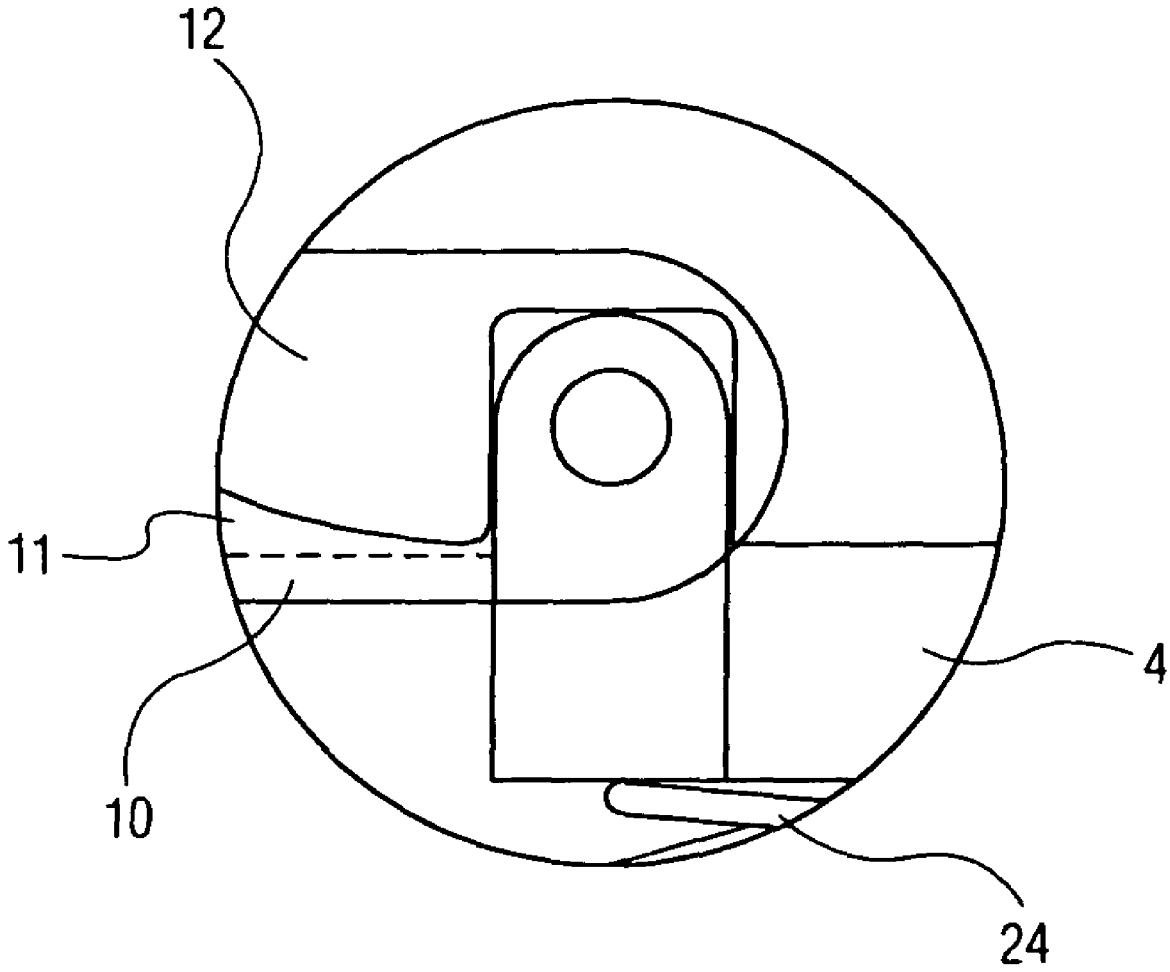

As shown in FIG. 2B, flange 14 may have locking mechanism 12, for example, a notch, arranged such that when bollard 2 and flange 14 are in a raised position, locking mechanism 12 interfaces with sled 4 thereby permitting bollard 2 and flange 14 to transfer force to sled 4.

Flange 14 may have a rounded portion that contacts and depresses sled 4, locking flange 14 into place, as bollard 2 and flange 14 pivot from a lowered position to a raised position. As bollard 2 and flange 14 approach a raised position, a portion of flange 14 may fit within piston slot 11, shown in dashed lines in FIGS. 2A and 2B, and further shown in FIGS. 4A, 4B and 4C. In another aspect, flange 14 may have a slot (not shown) accommodating piston 10 when bollard 2 and flange 14 are in a raised position.

Spring 24 may be immovably fixed to bottom of pit and may provide upward force against sled 4 to assist maintaining a connection between locking mechanism 12 and sled 4.

Sled 4 may connect to energy absorber 8, and sled 4 may interface with sled guide 16. Energy absorber 8 may be any device or system that dissipates, redirects or absorbs energy. Energy absorber 8 and sled guide 16 may be immovably fixed to pit. Energy absorber 8 may be a shock absorber having piston 10 connected to sled 4. In other aspects, energy absorber 8 may include a dynamic breaking system, one or more shear pins, springs, foams, pneumatics, hydraulics, woven cable or cloth, friction bearings, breakable concrete or crushable metals or systems utilizing gravity or counterbalance weights. It may be understood that components in the system of the present disclosure may be fabricated using metal or similar material.

Figure 3:
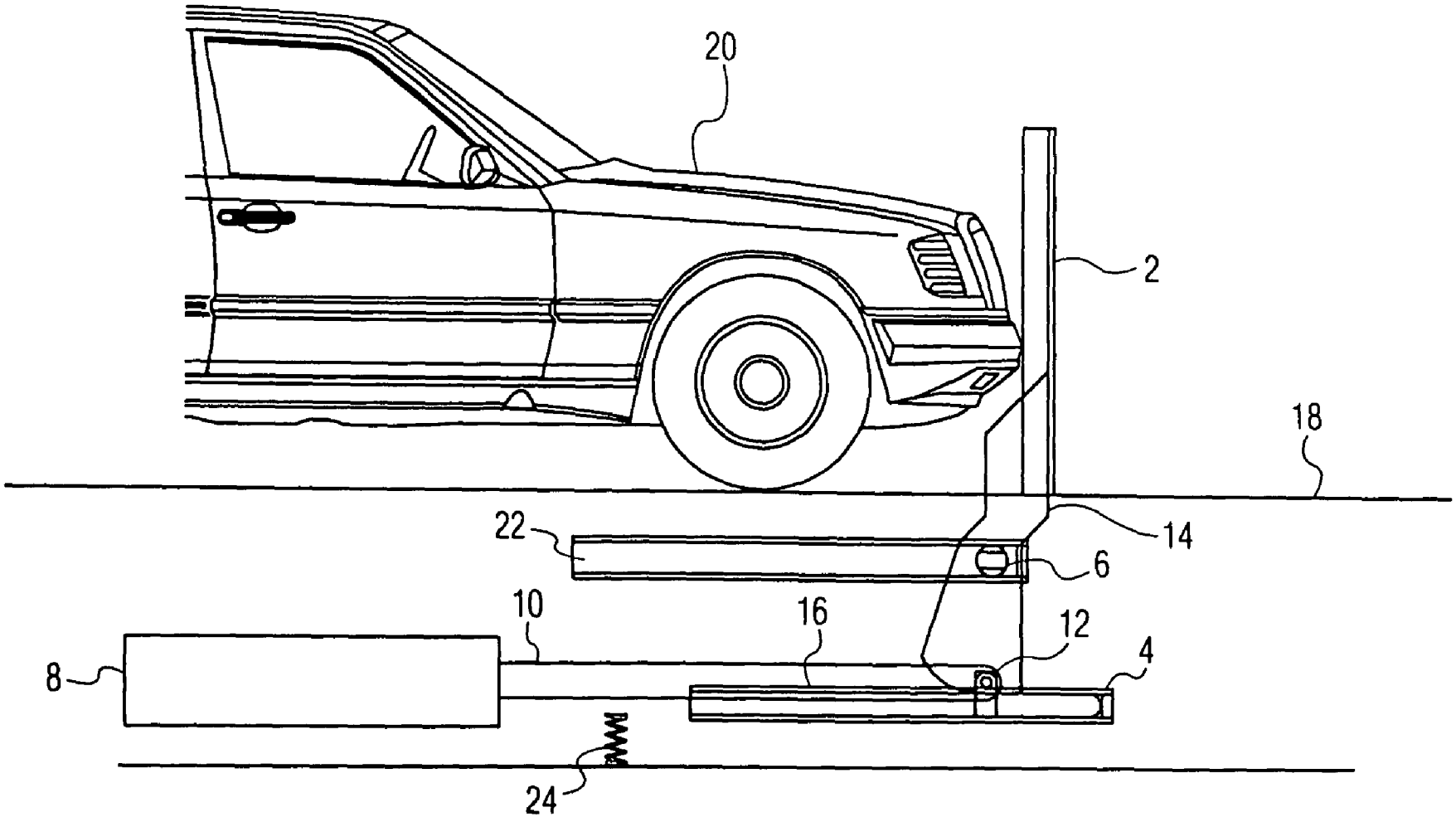
FIG. 3 shows a side view of an energy absorbing bollard system according to an aspect of the present disclosure.

As shown in FIG. 3, vehicle 20 traveling at ground level 18 may make contact with bollard 2 in a raised position, thereby causing bollard 2, flange 14 and sled 4 to travel horizontally from an original position. Horizontal displacement of sled 4 causes piston 10 to extend from a compressed state to an extended state, thereby causing energy absorber 8 to absorb energy such that vehicle 20 decelerates. During horizontal displacement, flange 14 is guided as hinge 6 travels along flange guide 22 and as sled 4 travels along sled guide 16.

Figure 4A:
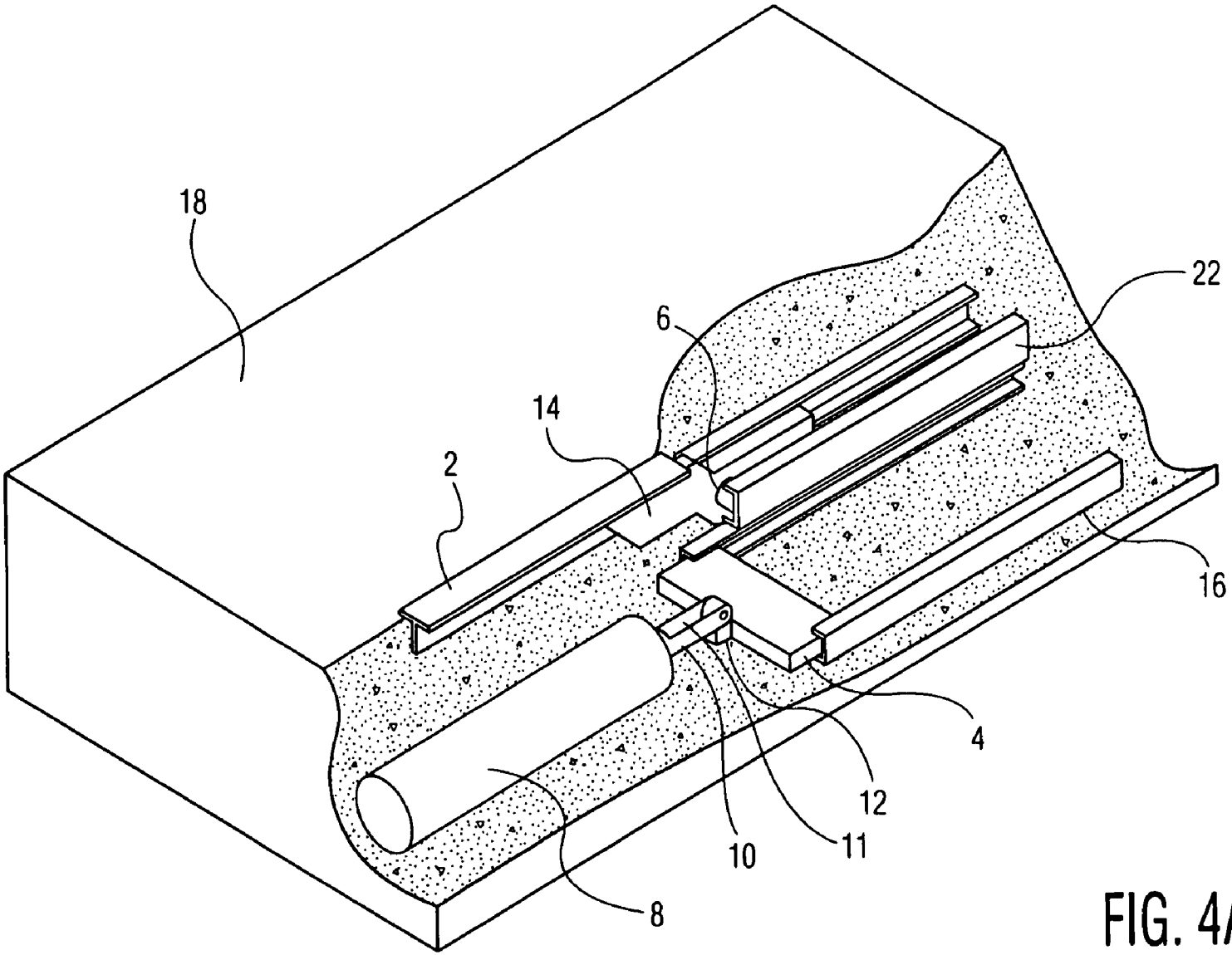
FIGS. 4A, 4B and 4C show perspective views of an energy absorbing bollard system according to an aspect of the present disclosure.
Figure 4B:
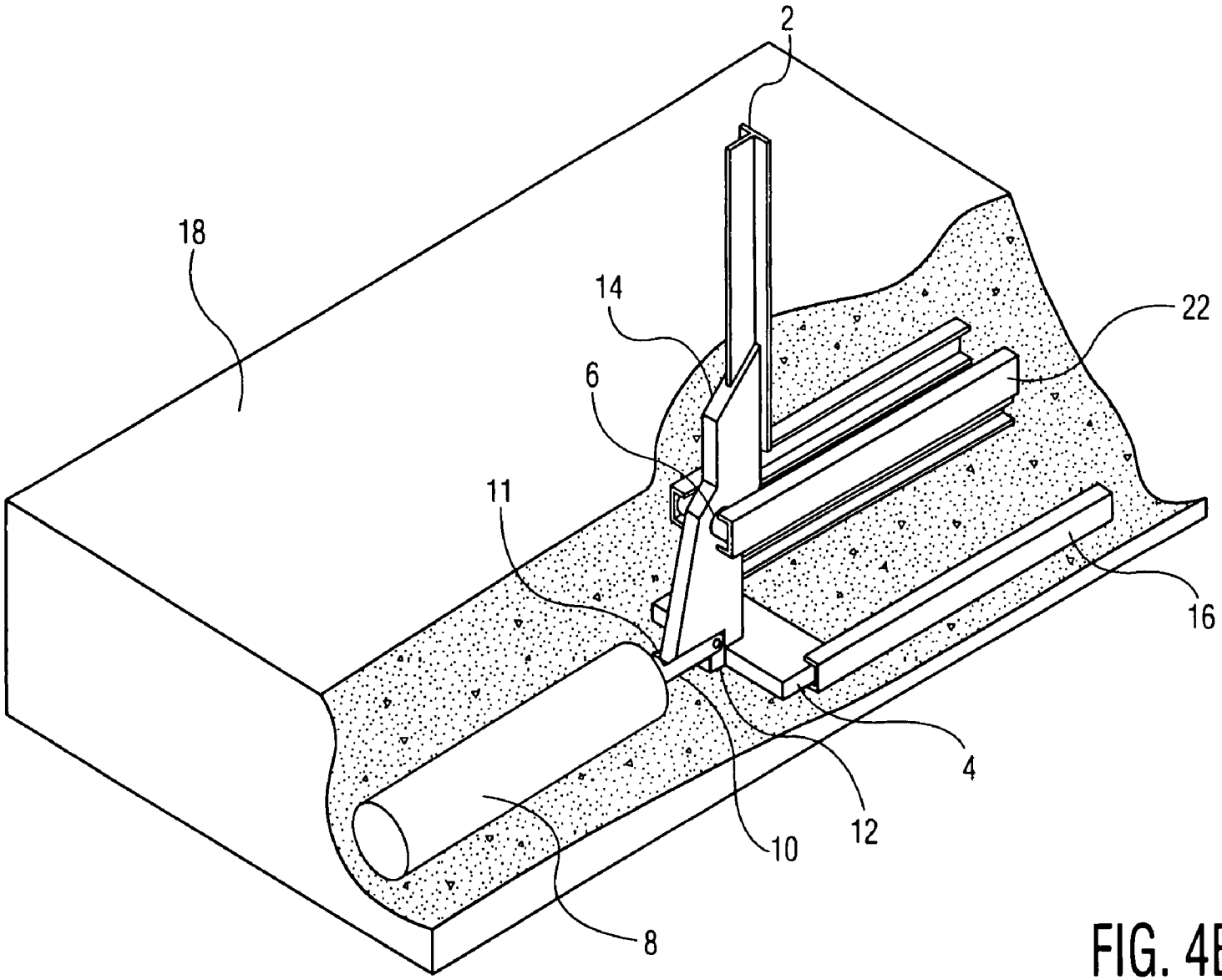
Figure 4C:
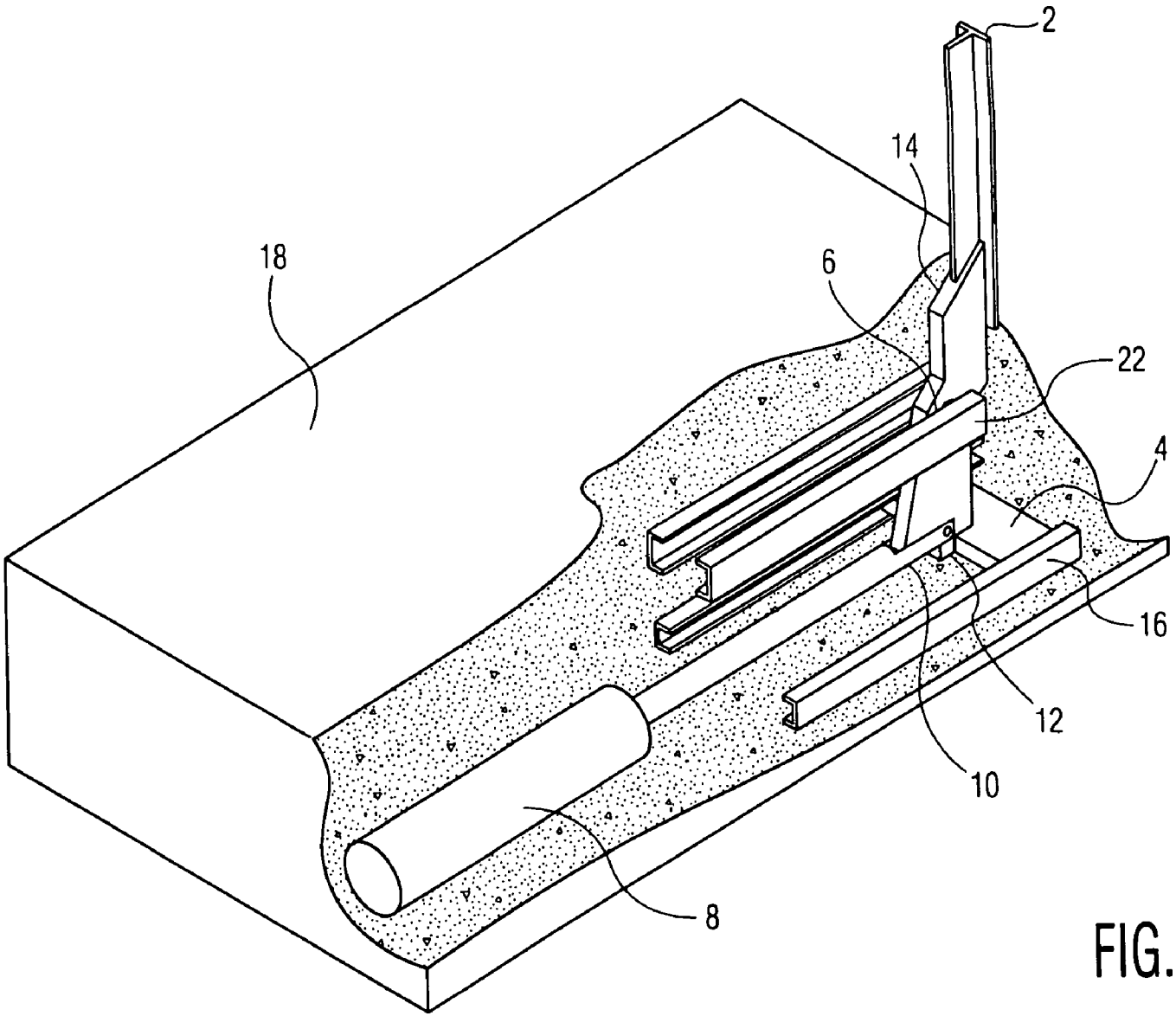

FIGS. 4A, 4B and 4C show perspective views of an energy absorbing bollard system. FIG. 4A shows bollard 2 in lowered original position, FIG. 4B shows bollard 2 in raised original position, and FIG. 4C shows bollard 2 in raised displaced position with sled 4 displaced and piston 10 extended.

Figure 5:
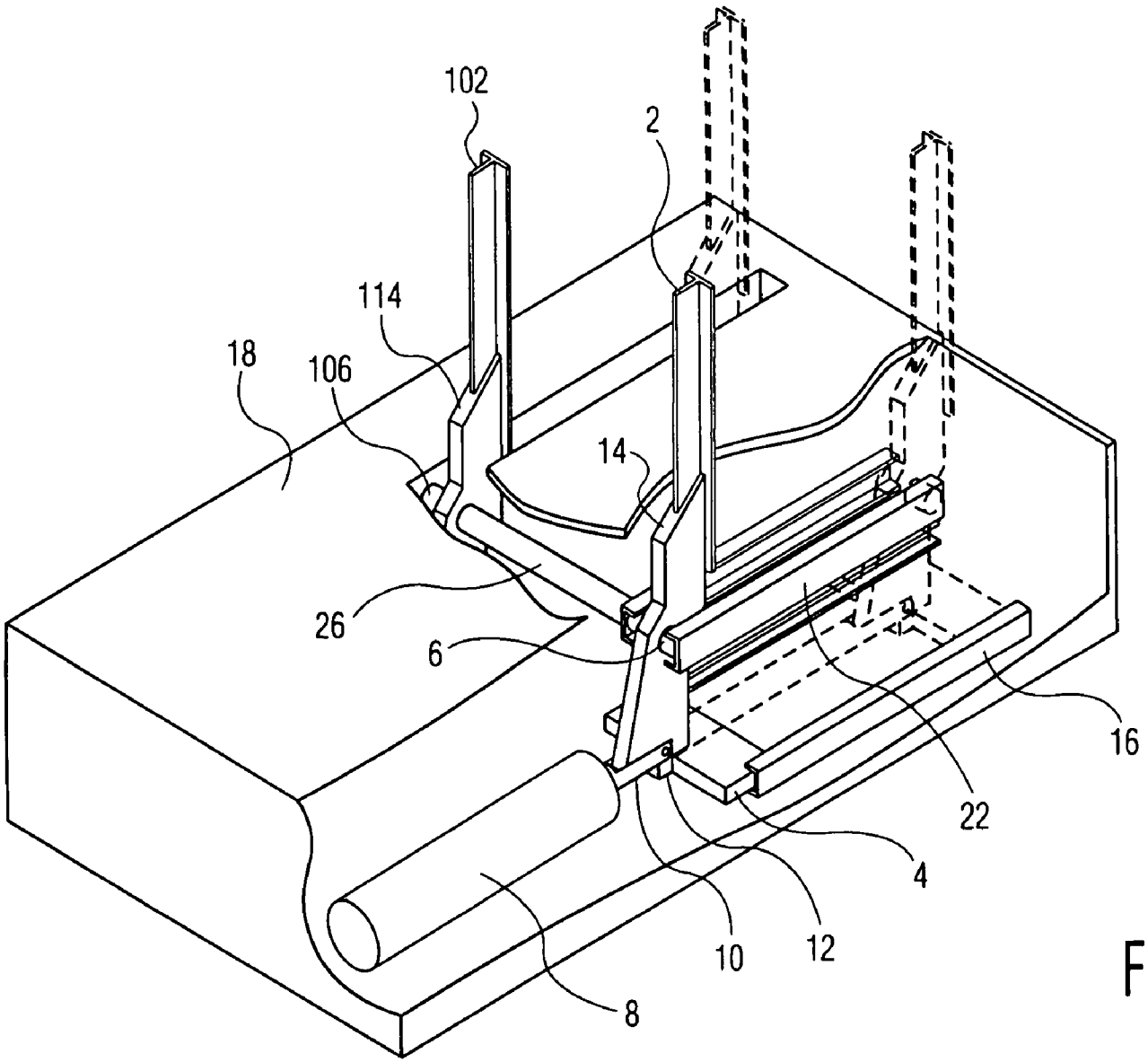
FIG. 5 shows a perspective view of an energy absorbing bollard system according to another aspect of the present disclosure.

FIG. 5 shows a perspective view of an energy absorbing bollard system according to another aspect of the present disclosure. Hinge 106 of flange 114 may be connected to hinge 6 of flange 14 by a connector 26 that may transfer force between flange 114 and flange 14 such that the two may travel simultaneously. Connector 26 may pass through an opening (not shown) in flange guide 22.

In another aspect, hinge 106 and flange 114 may connect with one or more of a second flange guide, second energy absorber, and second sled guide via second sled (not shown).

In another aspect, an opening in the ground through which bollard 2 travels from original to displaced position may be covered by disposable sheet of metal, plastic or foam insert that breaks away as bollard 2 travels from original to displaced position.

Figure 6:
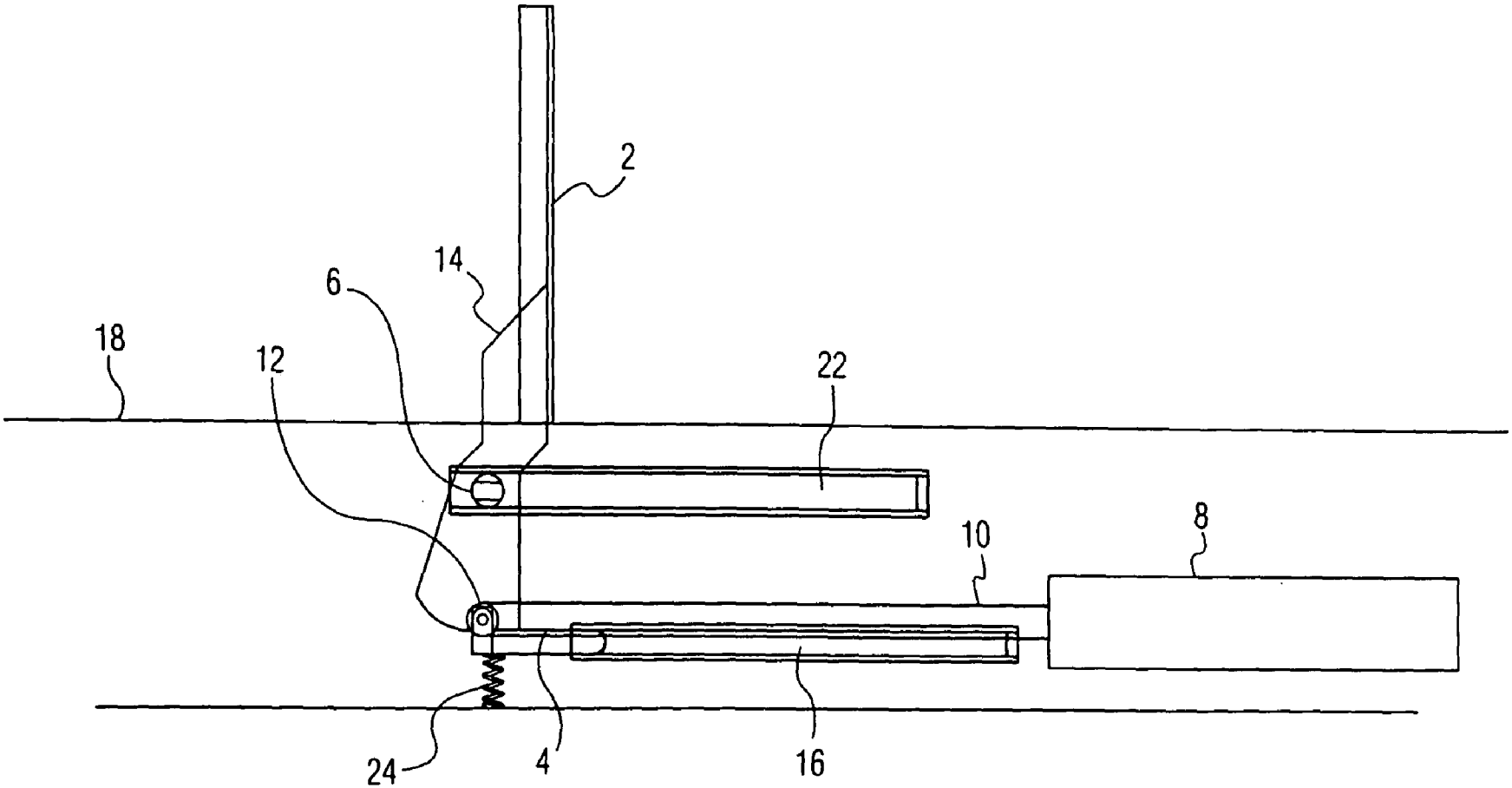
FIG. 6 shows a side view of an energy absorbing bollard system according to another aspect of the present disclosure.

FIG. 6 shows a side view of an energy absorbing bollard system according to another aspect of the present disclosure. In this aspect, energy absorber 8 may be arranged so that when sled 4 is in an original state, piston 10 is in an extended state and as sled 4 travels horizontally, piston 10 compresses and energy absorber 8 absorbs energy.

In other aspects, as may be understood by one skilled in the art, combinations of one or more energy absorbers 8 may be used in compression and extension configurations to effectuate energy absorption.

Figure 7A:
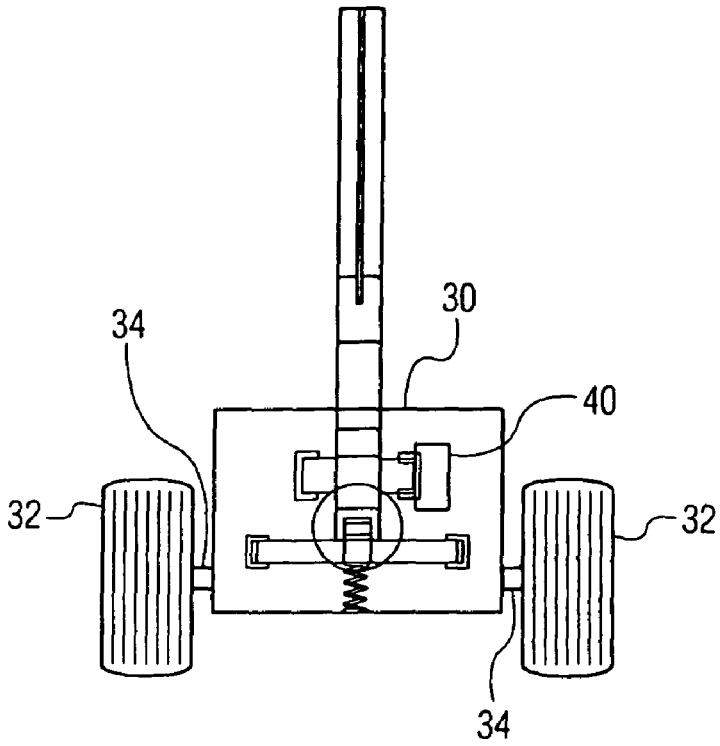
FIGS. 7A and 7B show front and side views of an energy absorbing bollard system according to another aspect of the present disclosure.
Figure 7B:
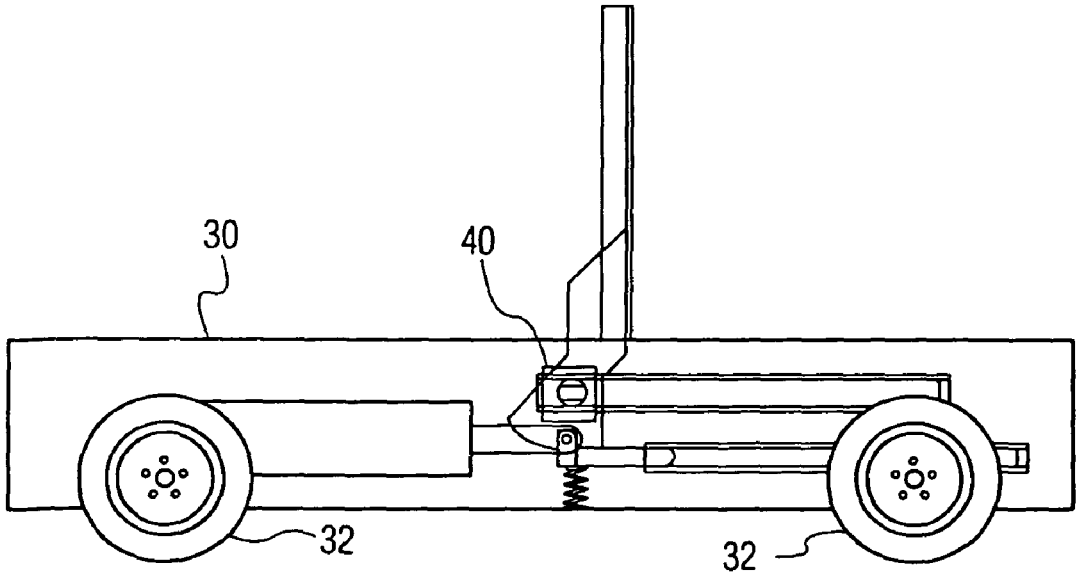

As shown in FIGS. 7A and 7B, bollard 2, sled 4, hinge 6, energy absorber 8, flange 14, sled guide 16, flange guide 22 and raising lowering device 40 may be arranged within housing 30, which may be used to facilitate portability and may provide a secure, sealed enclosure for the preservation of the internal workings of the system from contaminants and moisture. Housing 30 may be of a height and width such that a vehicle may drive over housing 30 and may have little or no contact with housing 30 before encountering bollard 2. In another aspect, housing 30 may have a sloped front portion (not shown) to further prevent contact with a vehicle.

Housing 30 may include wheels 32 or casters, tracks/treads, or rollers to facilitate transportation and orientation. Wheels 32 may be used in conjunction with trailer-hitches, goose-neck attachments, or fifth-wheel style attachments. Wheels 32 may be affixed using axle 34, or using independent axle, tandem axle, removable, or hinged wheels.

Figure 15A:
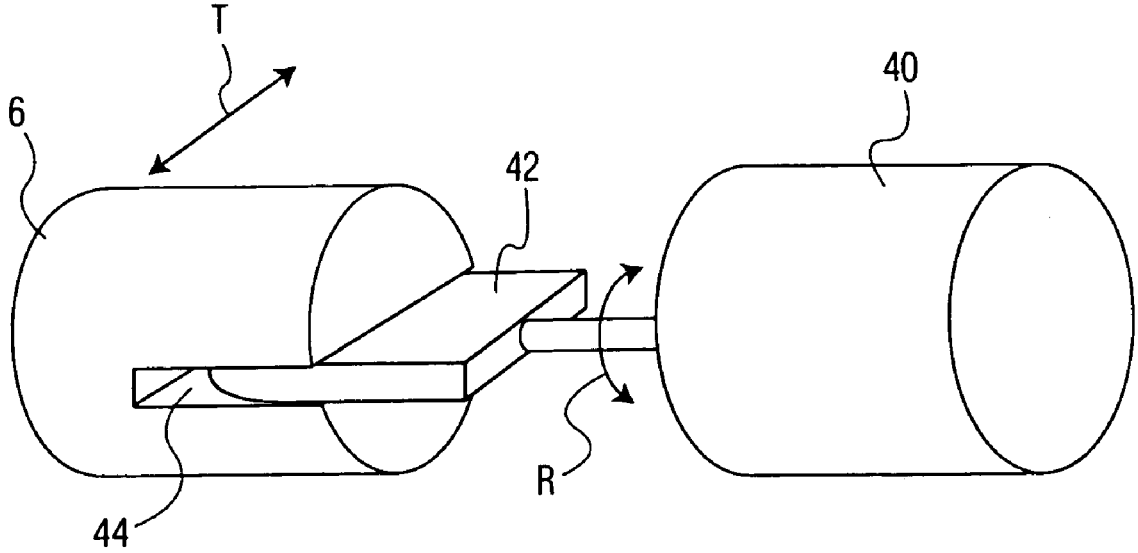
FIGS. 15A and 15B show perspective views of a motor and hinge according to an aspect of the present disclosure.
Figure 15B:
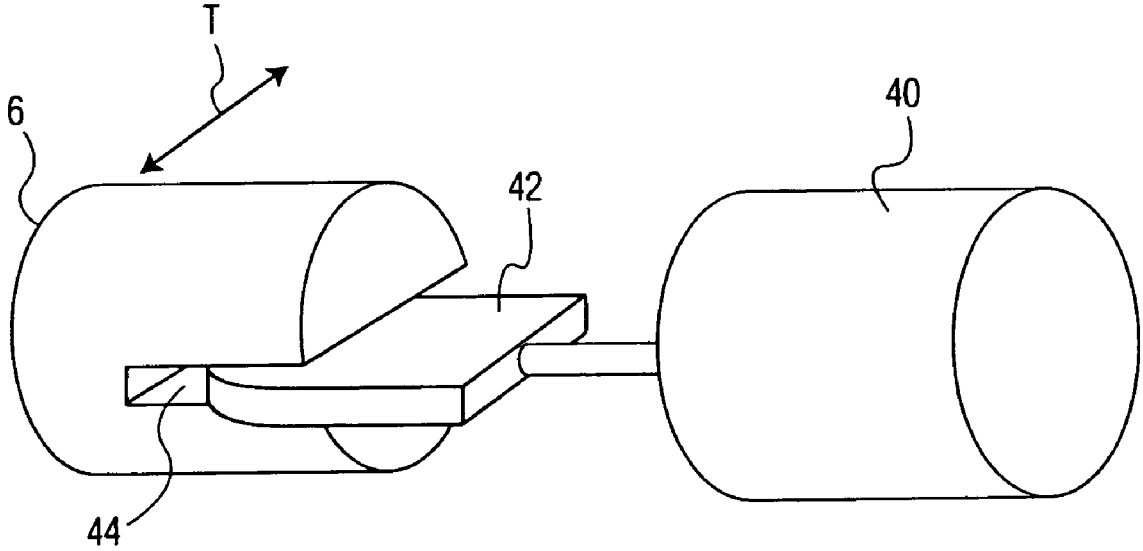

In this and other aspects, bollard 2 and flange 14 may be raised and/or lowered using a raising/lowering device 40 and hinge 6. As shown in FIG. 15A, raising/lowering device 40 may be, for example, an electric rotary motor, having a tab 42 that interfaces with a slot 44 in hinge 6. Raising/lowering device 40 may activate and turn tab 42 in a direction 'R', which applies force to slot 44 of hinge 6 and causes bollard 2 and flange 14 to pivot between raised and lowered positions. In one aspect, raising/lowering device may be immovably fixed, and tab 42 and slot 44 may be arranged so that when bollard 2 and flange 14 are in a raised position, tab 42 and slot 44 may become disengaged as bollard 2, flange 14 and hinge 6 travel away from an original position and away from raising/lowering device 40 in a direction 'T' as shown in FIG. 15B.

In another aspect, raising/lowering device 40 and locking mechanism 12, may be controlled by a computer system (not shown), operated automatically, for example, triggered by an external event or timer, or operated by a user. In other aspects, the bollard 2 and flange 14 may be raised/lowered manually using, for example, a lever, spring, hydraulic jack, air cylinder, rotation mechanism or counterweight.

Figure 8A:
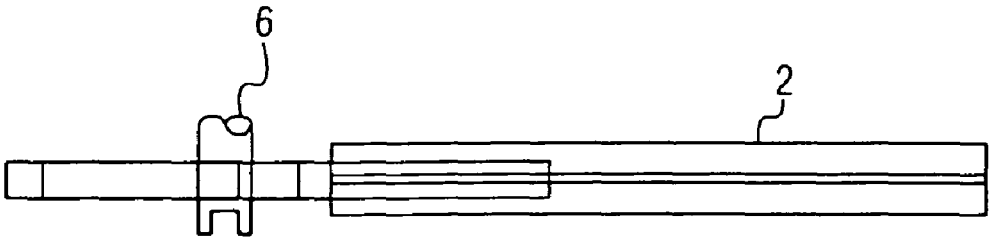
FIGS. 8A, 8B and 8C show front, side and top views of bollard and flange according to an aspect of the present disclosure.
Figure 8B:
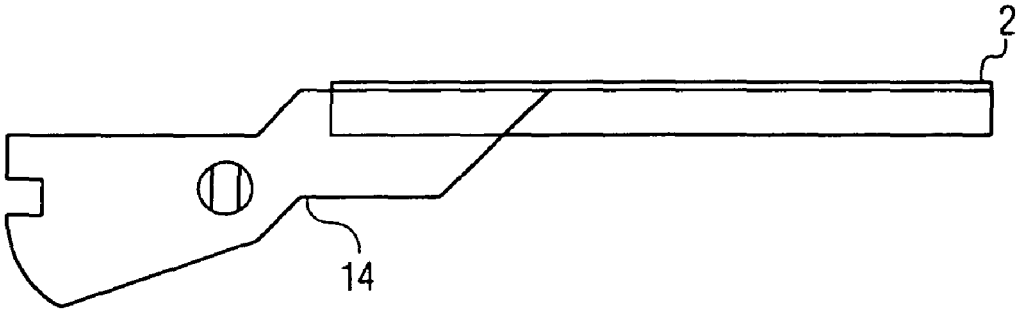
Figure 8C:
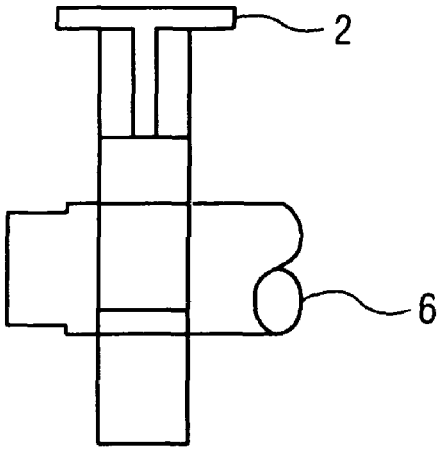

FIGS. 8A, 8B and 8C show front, side and top views of bollard 2, hinge 6 and flange 14 according to an aspect of the present disclosure.

Figure 9A:
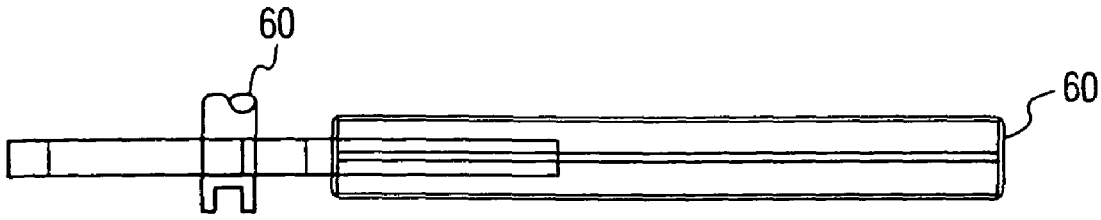
FIGS. 9A, 9B and 9C show front, side and top views of bollard, flange and bollard cover according to an aspect of the present disclosure.
Figure 9B:
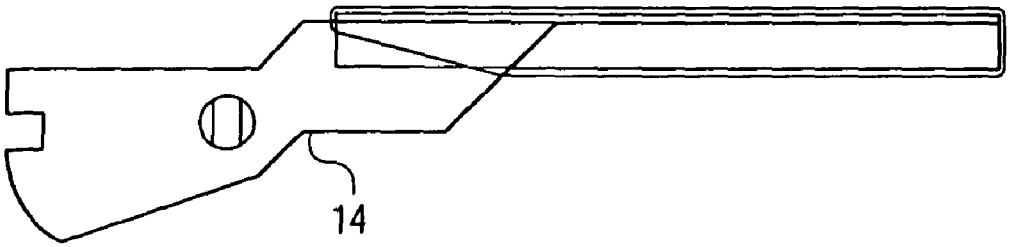
Figure 9C:
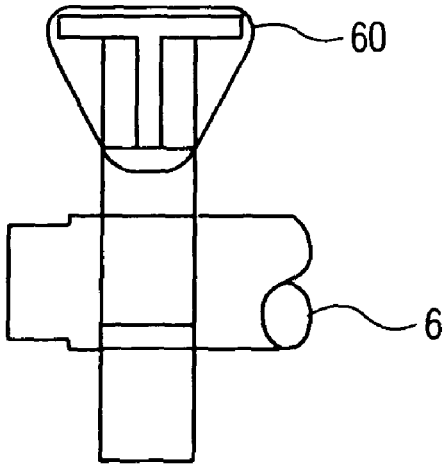

FIGS. 9A, 9B and 9C show front, side and top views of bollard 2, hinge 6, flange 14 and bollard cover 60 according to an aspect of the present disclosure. Bollard cover 60 may cover some or all of bollard 2 and may protect vehicle 20 and bollard 2 from damage, particularly during low speed impacts. Bollard cover 60 may be constructed using thick, compressible material (e.g. foam rubber) that deforms locally.

Figure 10:
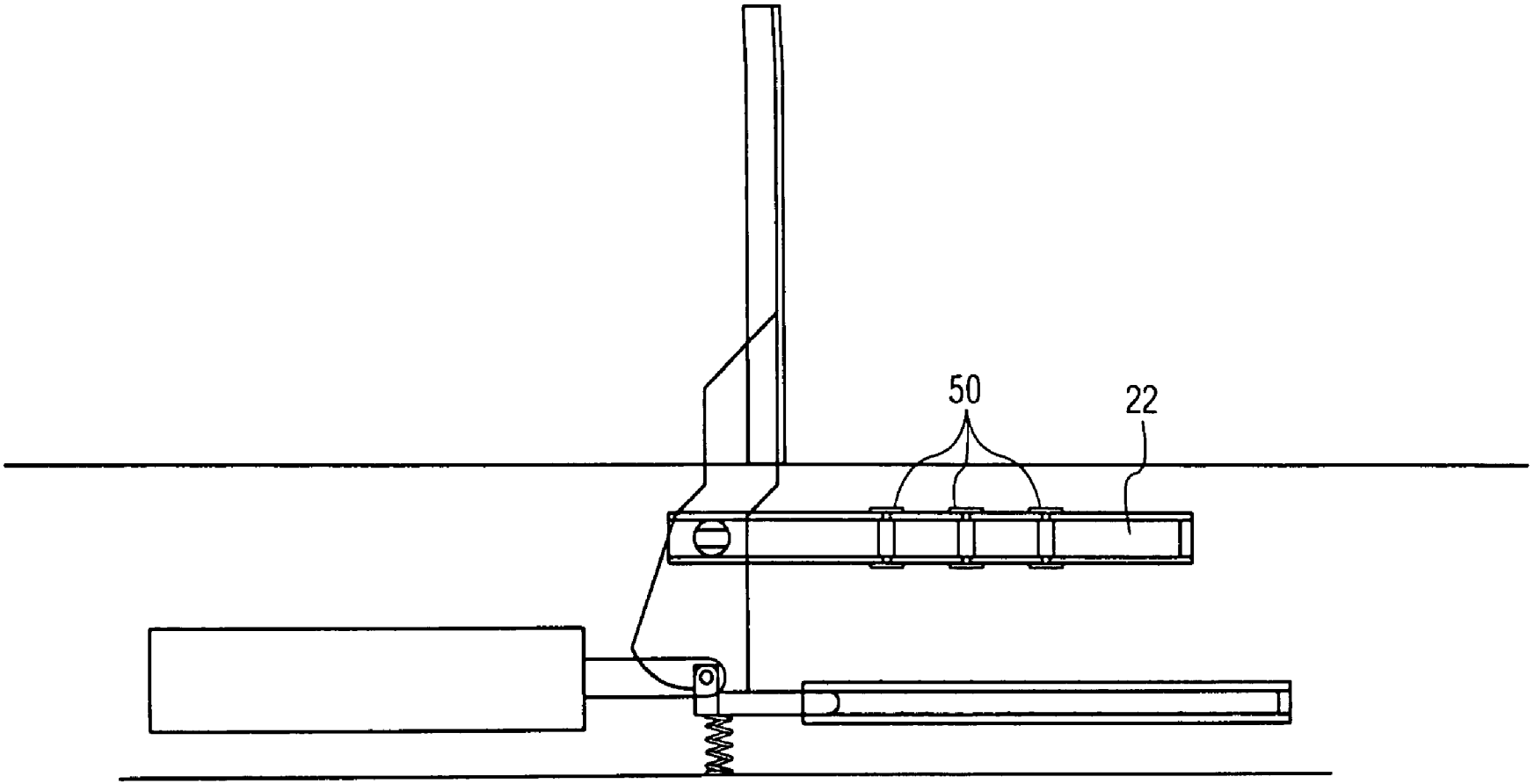
FIG. 10 shows a side view of an energy absorbing bollard system according to another aspect of the present disclosure.
Figure 11A:
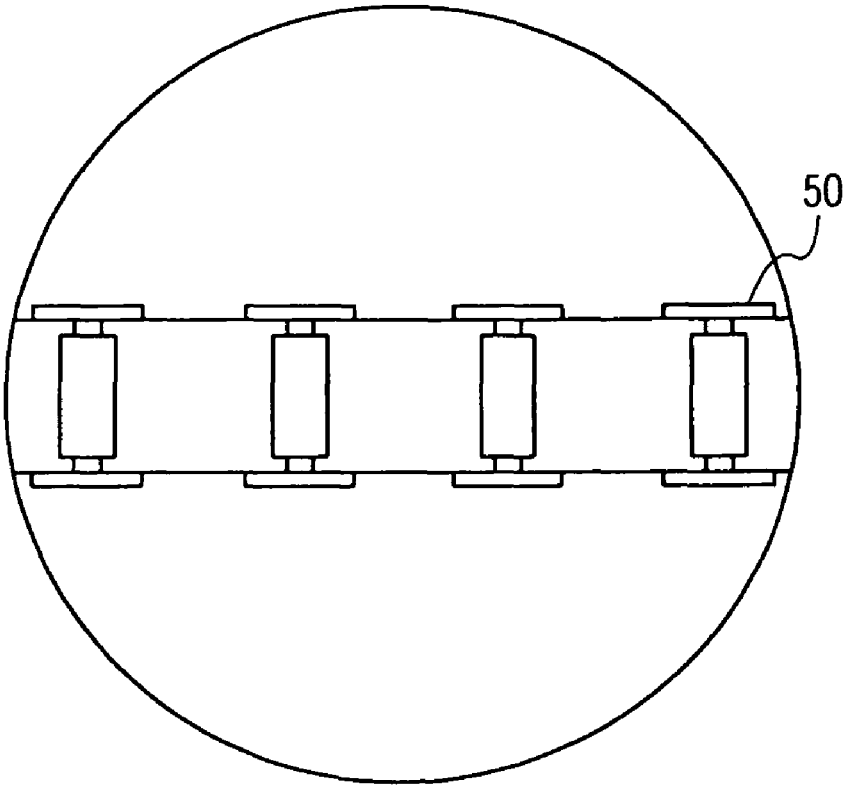
FIGS. 11A and 11B show top views of shear pins according to an aspect of the present disclosure.
Figure 11B:
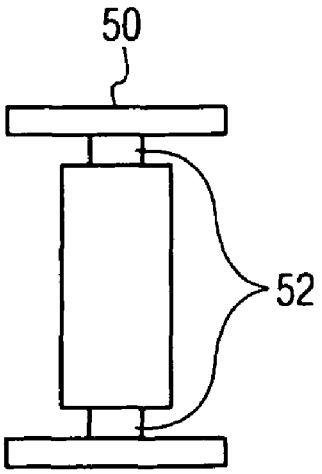

The system may include additional methods of energy dissipation or absorption. As shown in FIGS. 10 and 11A, flange guide 22, may be fitted with an arrangement of one or more supplemental energy absorbers, such as breakable shear pins 50. Hinge 6 may travel along a channel within flange guide 22 encountering shear pins 50 thereby causing bollard 2 to decelerate as it travels. As shown in FIG. 11B, shear pins 50 may break at shear zones 52 upon application of force based on specified shear strengths. Shear pins 50 may be arranged uniformly throughout flange guide 22 or at increments based on the type of installation. Similarly, in another aspect, sled guide 16 may be fitted with supplemental energy absorbers, and sled 4 may travel along a channel within sled guide 16 encountering such supplemental energy absorbers thereby causing bollard 2 to decelerate.

Figure 12:
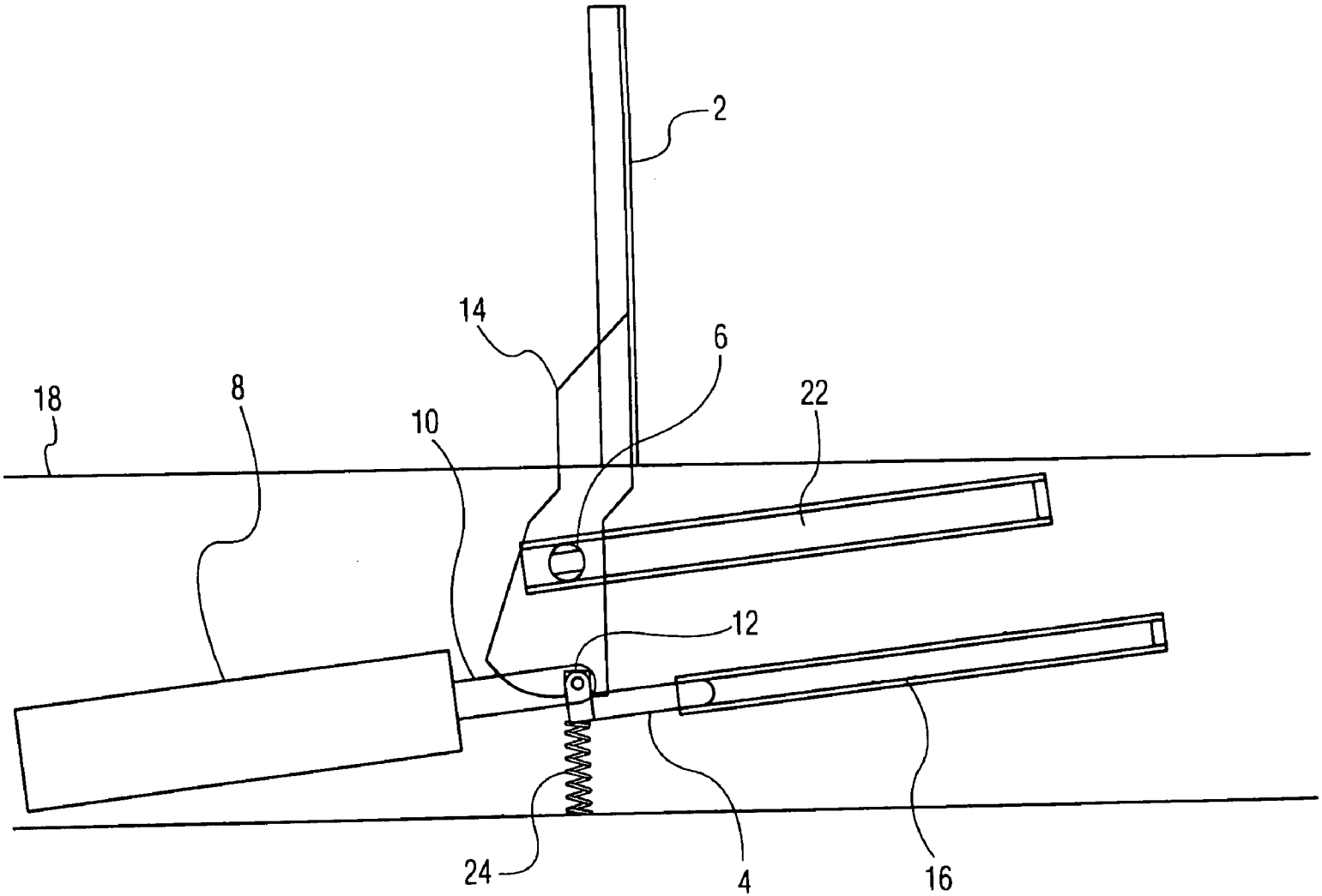
FIG. 12 shows a side view of an energy absorbing bollard system according to another aspect of the present disclosure.

As shown in FIG. 12, energy absorber 8, sled guide 16 and flange guide 22 arranged on an increasing slope, thereby causing the bollard 2, flange 14 and sled 4 to follow along that slope as they travel after impact, thereby absorbing energy.

Figure 13:
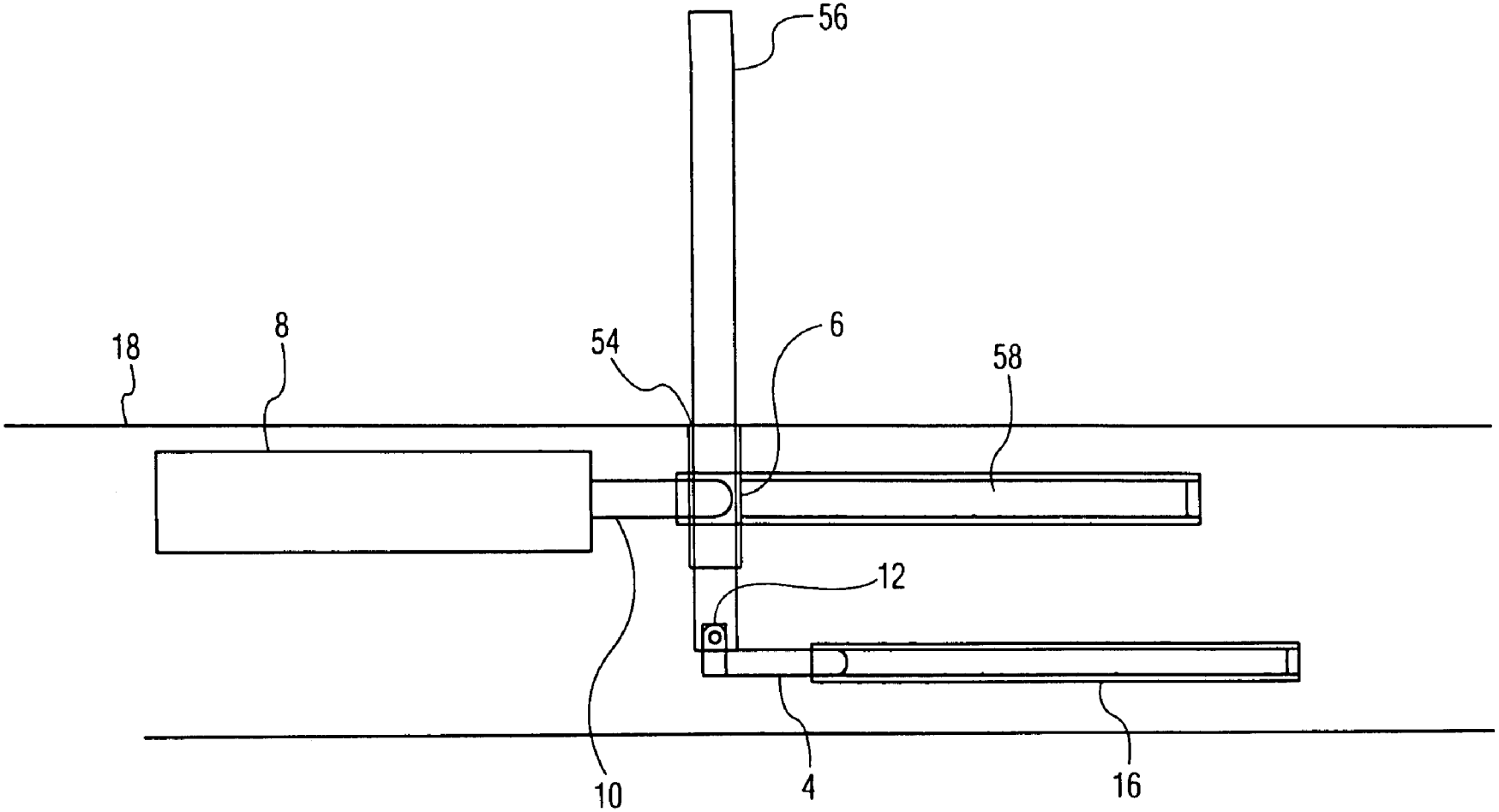
FIG. 13 shows a side view of an energy absorbing bollard system according to another aspect of the present disclosure.

Additional configurations are available, for example, as shown in FIG. 13, sleeve 54 may connect to sled 4 and may not move between raised and lowered positions. Insertable bollard 56 may be inserted into sleeve 54 until it locks into sled 4 via a depression, slot, groove or hole. In this aspect, piston 10 of energy absorber 8 may connect to sleeve 54, and piston 10 and sleeve 54 may travel along sleeve guide 58.

Figure 14:
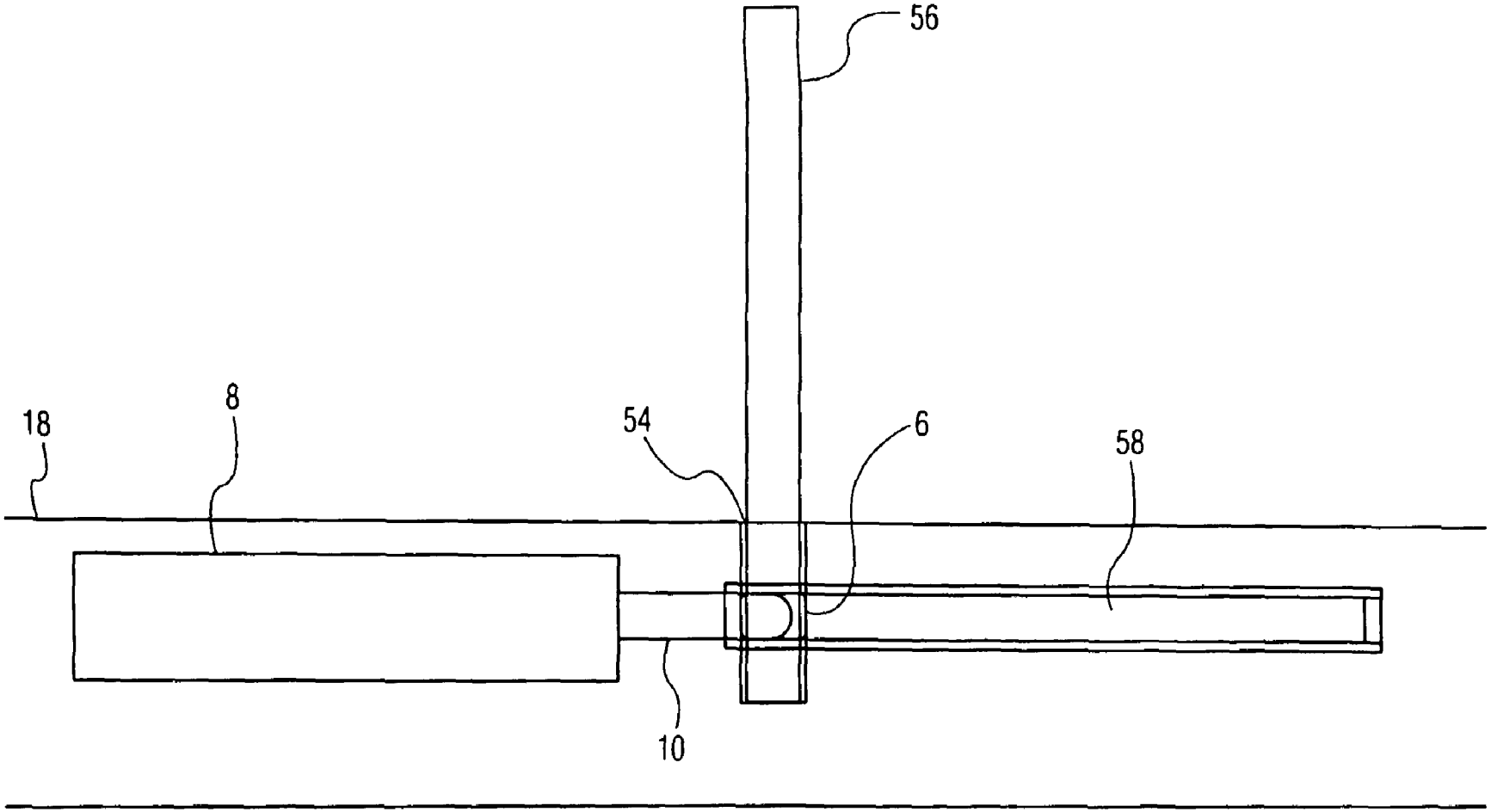
FIG. 14 shows a side view of an energy absorbing bollard system according to another aspect of the present disclosure.

As shown in FIG. 14, in another aspect, piston 10 of energy absorber 8 may connect to sleeve 54 and sled 4 and sled guide 16 may not be present.

Although illustrative embodiments have been described herein in detail, it should be noted and will be appreciated by those skilled in the art that numerous variations may be made within the scope of this invention without departing from the principle of this invention and without sacrificing its chief advantages.

Unless otherwise specifically stated, the terms and expressions have been used herein as terms of description and not terms of limitation. There is no intention to use the terms or expressions to exclude any equivalents of features shown and described or portions thereof and this invention should be defined in accordance with the claims that follow.

What is claimed is:

1. An energy absorbing system, comprising:

a supporting member;

a barrier pivotable between a first angular position and a second angular position, where the barrier is mechanically coupled to and pivotable about a hinge and becomes mechanically coupled to the supporting member when arranged at a predetermined angular position;

an energy absorber mechanically coupled to the supporting member, where the energy absorber absorbs energy when the supporting member travels from a first position to a second position; and a second barrier pivotable between a first angular position and a second angular position, where the second barrier becomes mechanically coupled to the supporting member when arranged at a predetermined angular position.

2. The energy absorbing system of claim 1, wherein the first angular position is substantially horizontal.

3. The energy absorbing system of claim 1, wherein the second angular position is substantially vertical.

4. The energy absorbing system of claim 1, wherein the predetermined angular position is between the first angular position and the second angular position.

5. The energy absorbing system of claim 1, wherein the energy absorber is arranged such that the energy absorber expands when the supporting member travels from the first position to the second position.

6. The energy absorbing system of claim 1, wherein the energy absorber is arranged such that the energy absorber compresses when the supporting member travels from the first position to the second position.

7. The energy absorbing system of claim 1, wherein the supporting member and the energy absorber are within a housing.

8. The energy absorbing system of claim 1, wherein the energy absorber is immovably fixed substantially below ground level.

9. The energy absorbing system of claim 1, wherein the energy absorber is a shock absorber.

10. The energy absorbing system of claim 9, wherein a piston of the shock absorber is mechanically coupled to the supporting member.

11. The energy absorbing system of claim 1, further comprising:

a motor interfacing with the hinge and causing the barrier to pivot between the first angular position and the second angular position.

12. The energy absorbing system of claim 1, further comprising:

a supporting member guide mechanically coupled to the supporting member and arranged such that the supporting member guide causes the supporting member to move in a predetermined path when the supporting member moves from the first position to the second position.

13. The energy absorbing system of claim 12, further comprising:

one or more frangible members arranged within the supporting member guide, wherein the one or more frangible members break when the supporting member moves from the first position to the second position.

14. The energy absorbing system of claim 1, further comprising:

a barrier guide mechanically coupled to the barrier and arranged such that the barrier guide causes the barrier to move in a predetermined path when the barrier moves from the first position to the second position.

15. The energy absorbing system of claim 14, further comprising:

one or more frangible members arranged within the barrier guide, wherein the one or more frangible members break when the barrier moves from the first position to the second position.

16. The energy absorbing system of claim 1, further comprising:

a first rotation limiter mechanically coupled to the barrier that limits the barrier from pivoting beyond the second angular position.

17. The energy absorbing system of claim 1, further comprising:

a barrier cover covering at least a portion of the barrier.

18. An energy absorbing system, comprising:

a supporting member;

a barrier pivotable between a first angular position and a predetermined angle, where the barrier mechanically couples to the supporting member when arranged at the predetermined angle;

an energy absorber mechanically coupled to the supporting member, where the energy absorber absorbs energy when the supporting member travels from a first position to a second position;

a barrier guide mechanically coupled to the barrier and arranged such that the barrier guide causes the barrier to move in a predetermined path when the barrier moves from the first position to the second position;

a supporting member guide mechanically coupled to the supporting member and arranged such that the supporting member guide causes the supporting member to move in a predetermined path when the supporting member moves from the first position to the second position;

wherein the barrier guide, supporting member guide and energy absorber are arranged at a predetermined angle; and a second barrier pivotable between a first angular position and a second angular position, where the second barrier becomes mechanically coupled to the supporting member when arranged at a predetermined angular position.

19. An energy absorbing system, comprising:

a barrier;

an energy absorber mechanically coupled to the barrier, where the energy absorber absorbs energy when the barrier travels from a first position to a second position; and a barrier guide mechanically coupled to the barrier and arranged such that the barrier guide causes the barrier to move in a direction of the barrier guide when the barrier moves from the first position to the second position, wherein the second position is linearly displaced from the first location; and a second barrier pivotable between a first angular position and a second angular position, where the second barrier becomes mechanically coupled to the supporting member when arranged at a predetermined angular position.

* * * * *